US006598660B1

(12) United States Patent
Sucker et al.

(10) Patent No.: US 6,598,660 B1
(45) Date of Patent: Jul. 29, 2003

(54) CASTING MOLD FOR CONTINUOUS CASTING OF METAL WITH A POURING AREA HAVING COOLED WIDE SIDEWALLS AND NARROW SIDEWALLS AND TAPERING IN A FUNNEL SHAPE

(75) Inventors: Jürgen Sucker, Düsseldorf (DE); Romeo Capotosti, Marhi (IT)

(73) Assignee: SMS Demag AG and Acciai Speiciali Terni S.p.A., Terni (IT)

( * ) Notice: Subject to any disclaimer, the term of this patent is extended or adjusted under 35 U.S.C. 154(b) by 0 days.

(21) Appl. No.: 09/706,331

(22) Filed: Nov. 3, 2000

(30) Foreign Application Priority Data

Nov. 10, 1999 (DE) ..... 199 53 907
Feb. 25, 2000 (DE) ..... 100 09 073

(51) Int. Cl.[7] ..... B22D 11/04
(52) U.S. Cl. ..... 164/418; 164/459
(58) Field of Search ..... 164/418, 459, 164/485, 443

(56) References Cited

U.S. PATENT DOCUMENTS 4,694,880 A * 9/1987 Gladwin ..... 164/459
4,811,779 A * 3/1989 Streubel et al. ..... 164/418
4,953,615 A * 9/1990 Hulek ..... 164/417
5,651,411 A * 7/1997 Hirano et al. ..... 164/459
5,839,503 A * 11/1998 Pleschiutschnigg ..... 164/484
5,941,298 A * 8/1999 Pleschiutschnigg ..... 164/418
6,125,916 A * 10/2000 Arvedi et al. ..... 164/418

FOREIGN PATENT DOCUMENTS

DE 4435218 4/1995
DE 4436990 12/1995
DE 197 10 791 A1 9/1998

* cited by examiner

*Primary Examiner*—M. Alexandra Elve
*Assistant Examiner*—Len Tran
(74) *Attorney, Agent, or Firm*—Friedrich Kueffner

(57) ABSTRACT

A casting mold for continuously casting metal has a pouring area having cooled wide sidewalls and cooled narrow sidewalls. The pouring area tapers in a funnel shape in horizons arranged underneath each other in a casting direction to a format of a strand to be cast, wherein the wide sidewalls are sidewall plates having curved contour areas. At least within one height portion of the casting mold the curved contour areas are asymmetrical relative to a line intercepting center points of the narrow sidewalls.

1 Claim, 3 Drawing Sheets

CASTING MOLD FOR CONTINUOUS CASTING OF METAL WITH A POURING AREA HAVING COOLED WIDE SIDEWALLS AND NARROW SIDEWALLS AND TAPERING IN A FUNNEL SHAPE

BACKGROUND OF THE INVENTION

1. Field of the Invention

The invention relates to a casting mold for continuous casting of metal with a pouring area having cooled wide sidewalls and cooled narrow sidewalls and tapering in a funnel shape in the casting direction in horizons that are positioned underneath one another to the shape of the continuous cast strand. The wide sidewalls have curved contour areas defining the pouring area.

2. Description of the Related Art

The dimensions of the pouring area are determined substantially by the cross-section of the strand to be cast, the dimensions of the pouring spout and channel, and its immersion depth into the melt.

The funnel-shaped embodiment of the pouring area is the result of attempts to cast a strand as thin as possible which, when exiting the casting mold, can be divided into slabs and rolled, after passing through a furnace, with at least partial use of the rolling heat.

As a result of the minimal strand cross-section, the casting speed must be correspondingly increased for maintaining the values conventional in the steel production in regard to casting time, casting temperature, and throughput of the cast strand. When reducing the strand thickness of approximately 250 mm for a conventional strand casting to approximately 50 mm, for example, for thin slab casting, this requires an increase of the casting speed by approximately a factor 5, for example, to values of approximately 5 to 6 m/min.

Based on the funnel-shaped form of the casting mold with curved contour areas of the wide sidewalls, as well as the minimal strand thickness and the comparatively high removal speed, strong currents result in the melt passing through the casting mold. Such flow conditions in the casting mold are characterized by the occurrence of circulating movements because a portion of the melt introduced into the casting mold flows from the immersed pouring spout and channel outwardly in the direction of the narrow sidewalls, is there deflected to the level of the bath, and at the height of the bath level flows into the direction of the strand center. This circulation is required to such an extent as in the upper lateral areas an impermissibly great cooling of the melt is to be prevented. When however the intensity of the current surpasses this required degree of circulation, an entrainment of slag or powder particles and their inclusion into the forming strand shell is additionally favored which can result in strong impairments of the surface quality of the cast product.

In a casting mold with funnel-shaped pouring area and curved contour areas of the wide sidewalls it is very difficult, as a result of the minimal strand cross-section and the high casting speed, to adjust the intensity of the aforementioned circulating current to the degree required for maintaining the uniform temperature of the melt. Because, as demonstrated by practical experience, the disadvantages of cooling of the bath level to a degree that is too great are the predominant effects, conventionally the casting parameters are adjusted such that on the bath level a directed flow, oriented away from the narrow sidewalls towards the strand center is provided which can be recognized by a significant excess rising of the bath level in the area of the narrow sidewalls.

As a result of practical experience of operating different strand casting devices it could be determined that when these circulating flows impact one another in the center of the casting mold with funnel-shaped pouring area and curved contours, additional undesirable bath level movements in the form of turbulences or fluctuations can result. This can cause, for example, flaws in the finish-rolled strips in the center of the strip which can be the result of inclusion of powder and slag particles into the strand shell forming within the bath level in the casting mold.

The document DE 44 35 218 A1 describes a casting mold for continuous casting of strands in the form of thin slab or steel strips. In the mold space formed of two cooled wide sidewalls and narrow sidewalls with a widened pouring area for receiving an immersion pouring spout and channel, the manufacture is simplified, the surface of the cast strands improved, and the strand breakage risk is reduced when a mold wall of a first wide sidewall is planar and extends at an angle $\alpha$ of 2 to 10° to the vertical and a mold wall of the second wide sidewall has a curvature that widens in a direction opposite to the slant of the planar mold wall.

The document DE 197 10 791 A1 describes an oscillating casting mold for casting preferably thin slab and slab sizes in dimensional ranges of 40 to 150×500 to 3300 mm with casting speeds of up to 10 m/min with use of casting powder. The casting mold with immersion pouring spout comprises in the casting direction concave planar wide side plates which are symmetrical relative to the center and which are partially overlapped central-symmetrically by a funnel, respectively. This ensures a uniform heat flow over the entire casting mold with a predetermined immersion pouring spout shape. These casting mold features in connection with freely selectable immersion pouring spout features make it possible to realize, at a maximum desired casting output, flawless slab surfaces even at high casting speeds and for crack-sensitive steel qualities and a large width adjustment range of, for example, 500 to 1800 mm with a single casting mold type.

The document DE 44 36 990 C1 concerns an immersion pouring spout and channel for introduction of steel melt into a continuous casting mold having longitudinal and transverse sides. In order to realize an immersion pouring spout and channel which decreases the kinetic energy of the liquid steel in the area between the portion of the immersion pouring spout and channel immersed in the melt and the longitudinal sides of the casting mold with a constructively simple configuration and which effects in a predetermined way the flow formation of the liquid steel contained in the casting mold in the area of the bath level, it is suggested according to this prior art document to provide the outer wall of the immersion pouring spout and channel in the longitudinal area facing the longitudinal side of the casting mold with a shape which, independent of the immersion depth of the immersion pouring spout and channel in the melt, has a substantially constant spacing to the longitudinal sides of the casting mold. Moreover, it is suggested that the outer tube wall of the immersion pouring spout and channel in its areas facing the transverse sides of the casting mold has shaped elements which provide minimal resistance for the horizontal flow of the steel melt and the casting powder floating thereon.

SUMMARY OF THE INVENTION

It is an object of the present invention, based on the aforementioned recognition in regard to the formations of circulating flows in the melt of the casting mold and in view of the aforementioned prior art, to provide a casting mold of the aforementioned kind with which the flow conditions of the melt in the pouring area are improved such that, as a result of reduction of fluctuations of the bath level and turbulences on the bath level, a considerable minimization of the incidence of flaws of the slab surface caused by non-metal inclusions can be achieved.

In accordance with the present invention, this is achieved for a casting mold of the aforementioned kind in that at least on one height portion of the casting mold the funnel contours of the wide side plates are asymmetrical relative to the line (X—X) which connects the center points of the narrow sides.

According to the invention, a casting mold for continuous casting of metal, comprising a pouring area having cooled wide sidewalls 1, 1' and narrow sidewalls 2, 2' and tapering in a funnel shape in horizontal areas positioned underneath one another in the casting direction to the shape of the cast strand, which pouring area is formed by curved contour areas of the wide sidewalls 1, 1', is characterized in that in at least one height portion of the casting mold the funnel contours of the wide side plates 1, 1' are asymmetrical relative to the line x—x which connects the center points of the narrow sides.

By avoiding impact of the flow branches coming from the two narrow sides at the center of the casting mold, in that the melt, as a result of the design of the wide sidewalls with curved contour areas in the bath level area, are subjected to rotation about the immersion pouring spout and channel, the flow conditions overall are improved so that, by means of the reduction of the bath level fluctuations and turbulences, a considerable reduction of the incidence of flaws on the slab surface caused by undesirable inclusions is achieved.

Accordingly, the funnel-shaped pouring area is designed such that, at least at one horizon, a line A–A' which connects the points with respectively maximum funnel openings of the wide sidewalls, do not extend perpendicularly but at a slant to the line x—x which simultaneously connects the center points of the narrow sidewalls.

As a result of the thus generated asymmetric appearance of the cross-section of the hollow casting mold space, the flow coming from the narrow sides is preferably deflected in the vicinity of one of the two wide sidewalls, respectively. This causes in the two intermediate spaces, which are formed by the immersion pouring spout and channel together with the wide sidewalls, an opposite flow with rotation about the immersion pouring spout and channel. This rotation is generated in that, after leaving the intermediate spaces, the flow at each side of the immersion pouring spout and channel is deflected by the melt arriving from the narrow side.

According to the invention, the funnel-shaped pouring area can be formed such that the line y—y which connects the two points with the maximum funnel width does not extend perpendicularly to the line x—x which connects the two center points of the narrow sides.

In a further embodiment of the invention, the funnel-shaped pouring area can be shaped such that the points of the widest funnel width A–A' are moved relative to one another horizontally by a spacing range.

Moreover, the invention also provides that in the bath level area the outer contour of the immersion pouring spout and channel represents a parallelogram with rounded corners, which enhances the rotation of the melt about the immersion pouring spout and channel.

DESCRIPTION OF THE PREFERRED EMBODIMENTS

Figure 1:
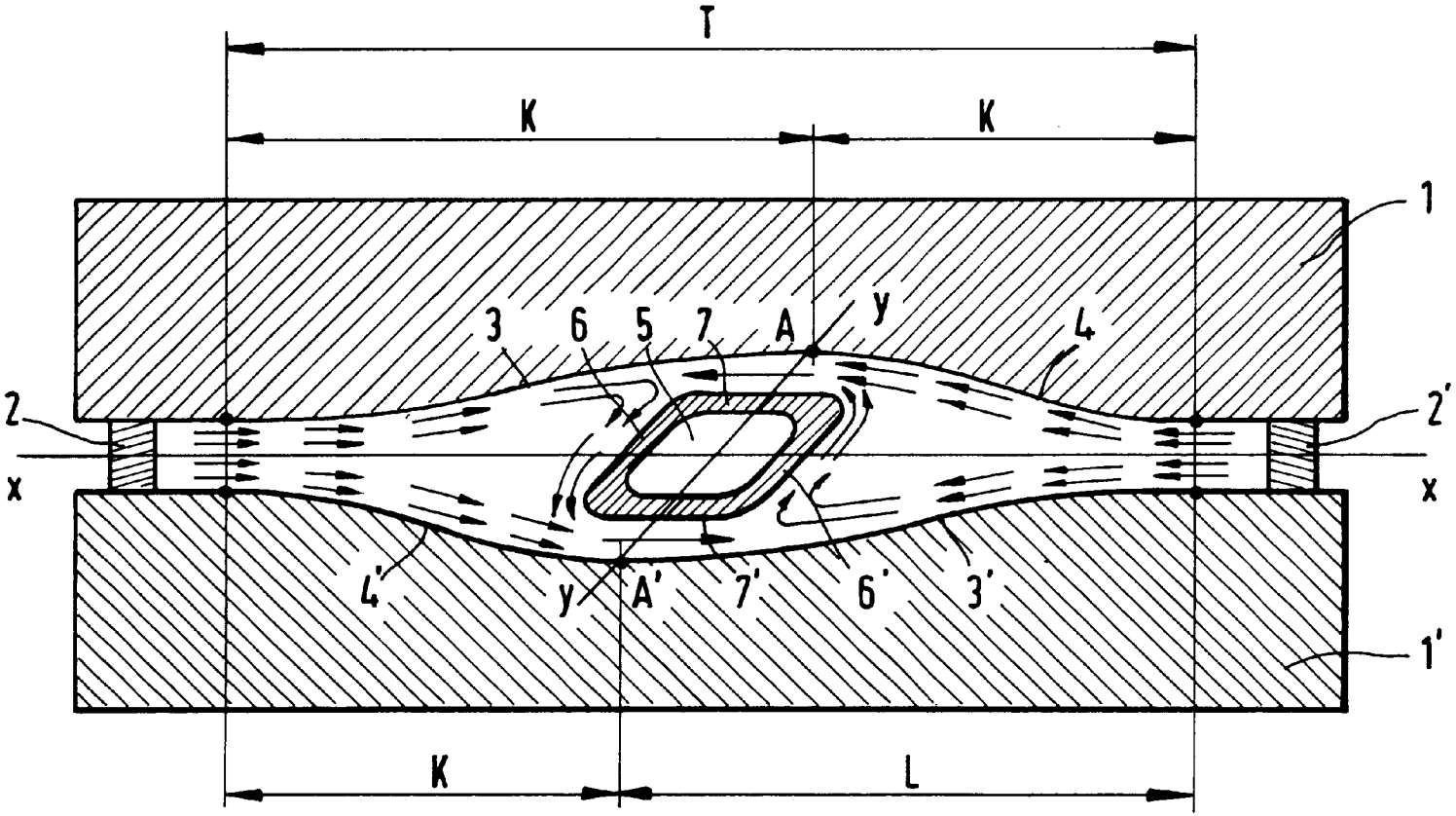
FIG. 1 is a cross-section of a casting mold with wide sidewalls 1, 1' and narrow sidewalls 2, 2' with side-inverted identical inner contour of the wide sidewalls and with an outer contour of the immersion pouring spout and channel in the form of a parallelogram with rounded corners.
Figure 2:
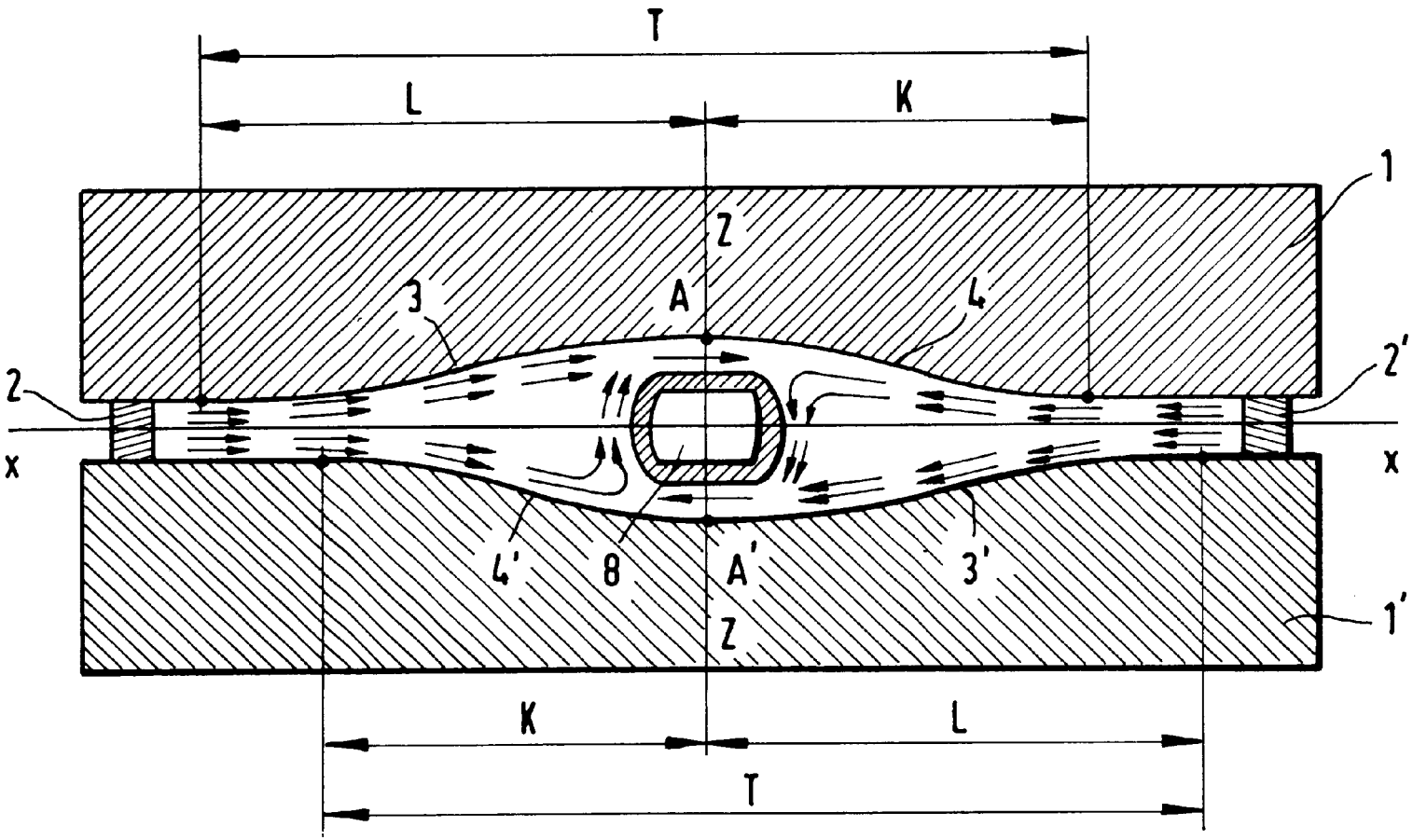
FIG. 2 is a further cross-section of a casting mold with wide sidewalls 1, 1' and narrow sidewalls 2, 2' with side-inverted identical inner contour of the wide sidewalls.
Figure 3:
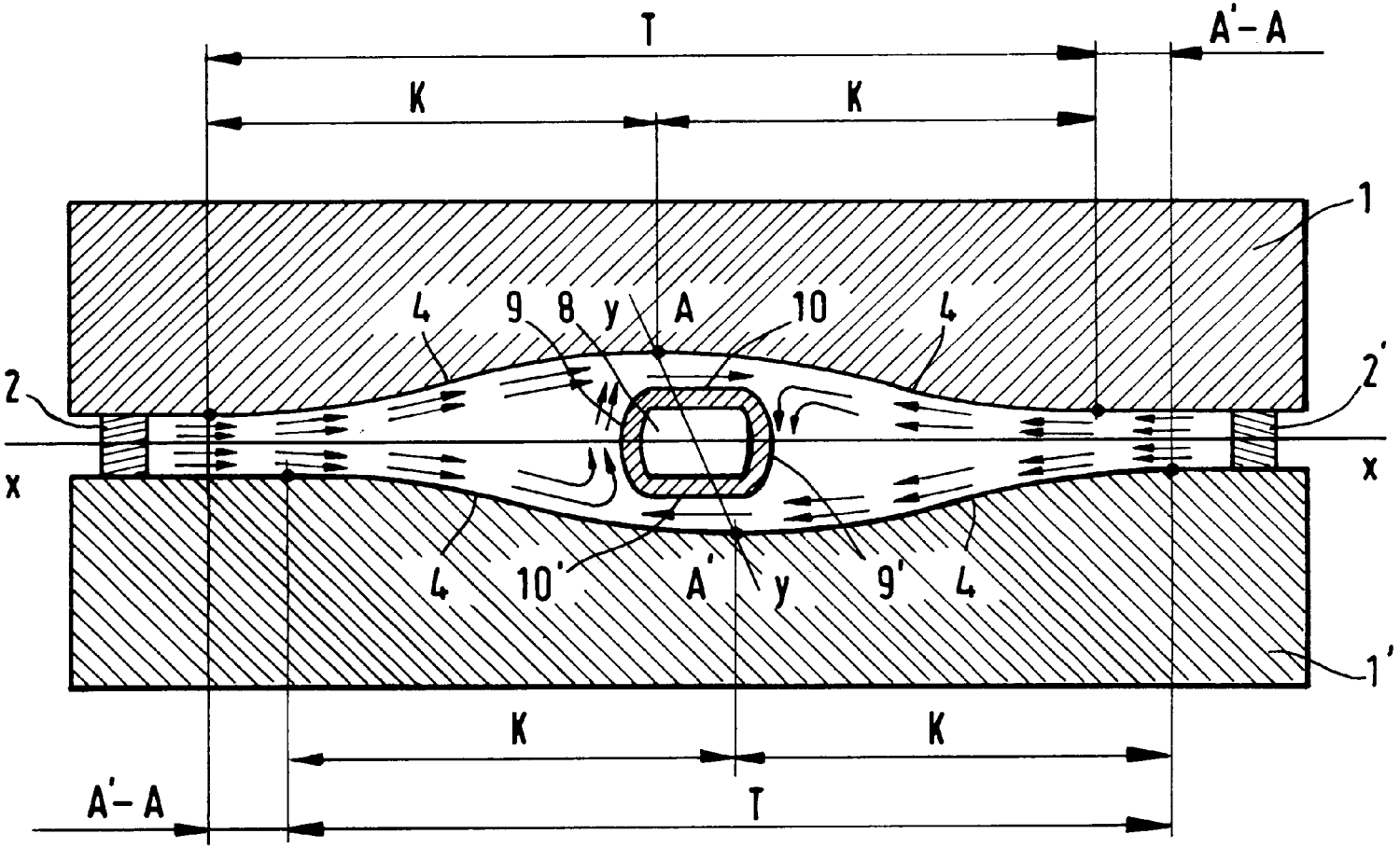
FIG. 3 is a cross-section of a casting mold with wide sidewalls 1, 1' and narrow sidewalls 2, 2' with identical inner contour of the wide sidewalls displaced relative to one another by a certain amount.

The continuous casting mold, when viewing all three FIGS. 1, 2, and 3 together, has two oppositely arranged wide sidewalls 1, 1' and two narrow sidewalls 2, 2' clamped between the wide sidewalls. The wide sidewalls (plates) 1, 1' have a funnel-shaped pouring area curved in the area of their upper edge. The pouring area tapers toward the narrow sides and in the casting direction to the shape of the cast strand.

According to the representation of FIG. 1, one embodiment of the invention provides that at the height level of the casting mold the horizontal contour of the funnel-shaped pouring area in each wide side plate 1, 1' is formed by two differently curved contour portions 3, 4 or 3', 4' with different lengths K, L wherein the different contour portions 3, 4, or 3', 4' are connected at the points of maximum funnel width A and A'. An important feature of this casting mold is that the line y—y which connects the two points of maximum funnel width A, A' does not extend perpendicularly to the line x—x which connects the center points of the narrow sides.

FIG. 2 shows that the inventive embodiment of the funnel-shaped pouring area is possible also when according to the prior art the line z—z, which connects the two points of maximum funnel width A, A', extends perpendicularly to the line x—x which connects the center points of the narrow sides. According to the invention it is only required that the points A, A' separate two different contour portions 3,4 or 3',4' from one another which have different curvature and different lengths K, L.

The embodiment of the funnel area illustrated in FIGS. 1 and 2 can be employed preferably for casting comparatively soft carbon steels and silicon-alloyed steels.

The design of the casting mold according to FIG. 3 proposes that the wide sidewalls 1, 1' have the same horizontal funnel contour with the width T=2k and the greatest funnel width at the points A, A' by using identical contour portions. As a result of a horizontal displacement of the two funnel contours about the spacing area A–A', the cross-section of the casting space is designed such that a rotating movement of the melt about the immersion pouring spout and channel is generated.

The advantage of this solution is that, due to the oppositely displaced funnel contour of the two wide sidewalls, a uniform configuration of the strand shell is ensured. This is especially desirable when casting comparatively hard steels, for example, austenitic, stainless steels, with comparatively minimal casting speeds.

The formation of the funnel-shaped pouring area by means of the different contour areas 3, 4 or 3', 4' used in connection with the embodiments of FIGS. 1 and 2 or by the displacement of identical funnel contours as illustrated in FIG. 3 a surprisingly simple realization of the formation of a melt flow rotating about the immersion pouring spout and channel 5 or 8 is provided. This avoids the disadvantageous impact of oppositely oriented flows of the melt, known from the prior art, which causes flaws of the slab surface as a result of non-metallic inclusions. The rotation of the melt is the result of the flow at each side of the immersion pouring spout and channel 5 or 8 being deflected by the melt arriving from the narrow side, as is illustrated in the FIGS. 1 to 3 by the direction of the arrows illustrating the melt movement.

According to the invention, it is especially advantageous to embody the hollow casting mold space in combination with the inventive embodiment of the outer contour 6-7-6'-7' of the immersion pouring spout and channel 5 with slanted stays or wall areas 6, 6', by which the rotation of the melt about the immersion pouring spout and channel 5 is further enhanced.

While specific embodiments of the invention have been shown and described in detail to illustrate the inventive principles, it will be understood that the invention may be embodied otherwise without departing from such principles.

What is claimed is:

1. A method for continuously casting metal in a mold having cooled wide sidewalls and cooled narrow sidewalls and comprising a pouring area tapering in a funnel shape in a casting direction to a format of a strand to be cast, the method comprising the step of:

subjecting the melt to rotation about an immersion pouring spout by configuring the wide sidewalls with curved contour portions at the bath level for guiding flow branches of the melt coming from the narrow sides so as to avoid impact of the flow branches of the melt coming from the two narrow sides at the center of the casting mold and by configuring the immersion pouring spout with a cross-section comprising two parallel walls facing the curved contour portions and curved stays connecting the two parallel walls, wherein the funnel shape has a greatest funnel width and wherein the points of the wide sidewalls defining the greatest funnel width divide the wide sidewalls in a horizontal plane into two different contour portions, respectively, wherein the different contour portions have at least one of a different length or a different course of curvature for generating the rotation of the melt.

* * * * *